US011821262B2

(12) United States Patent
Zhu et al.

(10) Patent No.: US 11,821,262 B2
(45) Date of Patent: Nov. 21, 2023

(54) LIFTING POSITIONING STRUCTURE FOR LADDER TOOL PLATFORM

(71) Applicant: Jiangsu Zhou Jijie Intelligent Technology Co., Ltd, Suqian (CN)

(72) Inventors: Chen Hui Zhu, Suqian (CN); Baisong Yao, Suqian (CN)

(73) Assignee: Jiangsu Zhou Jijie Intelligent Technology Co., Ltd, Suqian (CN)

( * ) Notice: Subject to any disclaimer, the term of this patent is extended or adjusted under 35 U.S.C. 154(b) by 867 days.

(21) Appl. No.: 16/741,750

(22) Filed: Jan. 14, 2020

(65) Prior Publication Data

US 2020/0240207 A1 Jul. 30, 2020

(30) Foreign Application Priority Data

Jan. 25, 2019 (CN) ..... 201920132347.X

(51) Int. Cl.

| | |
|---|---|
| ***E06C 7/04*** | (2006.01) |
| ***E06C 7/14*** | (2006.01) |
| ***E06C 7/18*** | (2006.01) |
| ***E06C 1/22*** | (2006.01) |
| ***E06C 1/393*** | (2006.01) |

(52) U.S. Cl.

CPC ..... *E06C 1/22* (2013.01); *E06C 1/393* (2013.01); *E06C 7/04* (2013.01); *E06C 7/14* (2013.01); *E06C 7/182* (2013.01)

(58) Field of Classification Search

CPC . E06C 1/22; E06C 1/393; E06C 1/125; E06C 1/30; E06C 7/04; E06C 7/14; E06C 7/182; E06C 7/50; E06C 7/02; F16B 2/185; Y10T 403/32475; Y10T 403/595

See application file for complete search history.

(56) References Cited

U.S. PATENT DOCUMENTS

| | | | | |
|---|---|---|---|---|
| 589,326 | A * | 8/1897 | Alexander | E06C 1/22 182/175 |
| 600,196 | A * | 3/1898 | Duryea | E06C 1/22 182/180.1 |
| 806,501 | A * | 12/1905 | Starinskij et al. | E06C 1/22 182/167 |
| 807,563 | A * | 12/1905 | Lester | F16B 1/00 403/322.4 |
| 841,707 | A * | 1/1907 | Murray | B62K 25/02 403/322.4 |

(Continued)

*Primary Examiner* — Jessica L Laux
*Assistant Examiner* — Kathleen M. McFarland
(74) *Attorney, Agent, or Firm* — Bayramoglu Law Offices LLC

(57) ABSTRACT

A lifting positioning structure for a ladder tool platform comprises a ladder. The ladder comprises front supporting legs, rear supporting legs, connectors fixedly connected to the front supporting legs, plug pins, and elastic parts, wherein each front supporting leg includes a big tube and a small tube which are able to relatively move in an extension direction. The connectors are formed with vertically-through installation cavities which allow the big tubes to be inserted therein. The big tubes are arranged in the installation cavities and are fixedly connected to the connectors which extend to form connection parts rotationally connected to the rear supporting legs. The small tubes are connected to a tool platform. The plug pins are movably arranged on the connectors or the big tubes.

11 Claims, 4 Drawing Sheets

(56) References Cited

U.S. PATENT DOCUMENTS 845,433 A * 2/1907 Peltier ..... E06C 1/393 182/124
870,940 A * 11/1907 Dahl ..... E06C 1/22 182/178.4
933,816 A * 9/1909 Bartos et al. ..... E06C 1/22 182/228.1
943,511 A * 12/1909 Binger et al. ..... E06C 1/22 182/172
2,576,277 A * 11/1951 Biegen ..... E06C 1/39 182/176
3,653,463 A * 4/1972 Neal ..... E06C 1/125 182/195
3,858,684 A * 1/1975 Goings ..... E06C 1/125 182/228.6
4,155,422 A * 5/1979 Larson ..... E06C 1/22 182/124
4,884,046 A * 11/1989 Spinner ..... H01R 13/633 333/260
4,943,181 A * 7/1990 Murphy ..... B23Q 7/043 403/324
5,590,739 A * 1/1997 High ..... E06C 1/397 182/208
6,651,774 B2 * 11/2003 Yoo ..... E06C 1/393 182/20
6,733,202 B2 * 5/2004 Couture ..... F16B 5/0621 403/374.1
7,100,739 B2 * 9/2006 Parker ..... E06C 1/393 182/163
7,255,198 B1 * 8/2007 Lo ..... E06C 1/22 182/172
7,383,920 B2 * 6/2008 Meeker ..... E06C 7/14 182/129
8,066,099 B2 * 11/2011 Liang ..... E06C 1/12 182/195
8,387,753 B2 * 3/2013 Kieffer ..... E06C 1/125 182/195
8,974,137 B2 * 3/2015 Parker ..... E02F 3/3672 37/468
9,368,049 B2 * 6/2016 Alkas ..... F16B 2/185
10,337,246 B1 * 7/2019 Wise ..... E06C 1/397
10,435,949 B2 * 10/2019 Christianson ..... E06C 7/50
2003/0155178 A1 * 8/2003 Yoo ..... E06C 1/393 182/20
2004/0000449 A1 * 1/2004 Meeker ..... E06C 1/387 182/165
2004/0022578 A1 * 2/2004 Couture ..... F16B 5/0621 403/322.4
2005/0121261 A1 * 6/2005 Moss ..... E06C 7/423 182/165
2005/0252721 A1 * 11/2005 Parker ..... E06C 1/005 182/165
2008/0000723 A1 * 1/2008 Kieffer ..... E06C 1/125 182/195
2008/0164097 A1 * 7/2008 Eriksson ..... E06C 1/125 182/22
2008/0185223 A1 * 8/2008 Lem ..... E06C 7/14 182/116
2011/0005864 A1 * 1/2011 Liang ..... E06C 1/12 182/209
2013/0160269 A1 * 6/2013 Parker ..... E02F 3/3672 403/373
2014/0259622 A1 * 9/2014 Alkas ..... G09F 15/0068 403/322.4
2017/0145745 A1 * 5/2017 Kieffer ..... E06C 7/42
2017/0254145 A1 * 9/2017 Ballard ..... E06C 1/22
2017/0260809 A1 * 9/2017 Leng ..... E06C 7/08
2018/0148977 A1 * 5/2018 Leng ..... E06C 1/393
2018/0238112 A1 * 8/2018 Era ..... E06C 7/06
2018/0340370 A1 * 11/2018 Nielsen ..... E06C 1/125
2020/0217134 A1 * 7/2020 Fortier ..... F16B 7/105

* cited by examiner

LIFTING POSITIONING STRUCTURE FOR LADDER TOOL PLATFORM

CROSS REFERENCE TO THE RELATED APPLICATIONS

This application is based upon and claims priority to Chinese Patent Application No. 201920132347.X, filed on Jan. 25, 2019, the entire contents of which are incorporated herein by reference.

TECHNICAL FIELD

The utility model relates to a lifting positioning structure for a ladder tool platform, and belongs to the technical field of home supplies.

BACKGROUND

A ladder having a stretchable backrest in the prior art comprises a pair of ladder legs and a plurality of pedals installed on the ladder legs, wherein connectors are arranged on the upper parts of the ladder legs, installation parts extend out of the connectors, a tool platform is pivotally connected with the installation parts through pivots, the lower part of the backrest is located between the connectors and the pivots, an elastic cushion block is arranged between the backrest and the pivots, and the tool platform has a cam part pressing against the cushion block. The tool platform can be folded to reduce the logistical size. However, the length of the ladder cannot be changed, and the height of the ladder cannot be adjusted as needed when the ladder is used.

SUMMARY

The objective of the utility model is to overcome the above shortcomings in the prior art by providing a lifting positioning structure for a ladder tool platform, which is reasonable in structural design and fulfills stable and reliable positioning.

The technical solution adopted by the utility model to fulfill the above-mentioned objective is as follows: a lifting positioning structure for a ladder tool platform is characterized in that a ladder comprises front supporting legs, rear supporting legs, connectors fixedly connected with the front supporting legs, plug pins, and elastic parts, wherein each front supporting leg includes a big tube and a small tube which are able to relatively move in an extension direction; the connectors are formed with vertically-through installation cavities which allow the big tubes to be inserted therein; the big tubes are arranged in the installation cavities and are fixedly connected with the connectors which extend to form connection parts rotationally connected with the rear supporting legs, and the small tubes are connected with a tool platform; the plug pins are movably arranged on the connectors or the big tubes; the elastic parts apply an acting force to the plug pins to make the plug pins tend to position the small tubes, and the small tubes are positioned after abutting against the plug pins; and the plug pins overcome the resistance of the elastic parts under an external force to move away from the small tubes, so that the small tubes are released from being positioned.

Wherein, the plug pins are provided with shield parts to abut against springs, the elastic parts are the springs disposed around the plug pins capable of moving along their axial directions, and the springs have one ends abutting against the shield parts and the other ends abutting against the connectors or derivative parts connected with the connectors.

Wherein, the small tubes arranged in the installation cavities are provided with flanges protruding relative to the external diameters of the small tubes, and covers are arranged over the mounting cavities; and when the small tubes move upwards, the flanges abut against the covers, and the plug pins are located at the lower ends of the small tubes, so that the small tubes are positioned.

Wherein, the small tubes are formed with holes allowing the plug pins to be inserted therein, and when the plug pins are inserted into the holes, the small tubes are positioned.

Wherein, the ladder further comprises rotary parts which are rotationally connected with the connectors and formed with arc grooves, the plug pins are connected with connection shafts arranged in the arc grooves, and a distance between the arc grooves and rotational connection points of the rotary parts and the connectors is variable; and the connection shafts move along the arc grooves by means of rotation of the rotary parts, and when positions of the connection shafts in the arc grooves tend to get close to the rotational connection points, the small tubes tend to be released from being positioned, otherwise, the small tubes tend to be positioned.

Wherein, the arc edges are arranged at the peripheries of the arc grooves and abut against the ends, abutting against the connectors or the derivative parts, of the springs.

Wherein, the number of the arc grooves is two, and the connection shafts are respectively arranged in the two arc grooves.

Wherein, the rotation shafts are arranged at the rotational connection points of the rotary parts and the connectors, are connected with the rotary parts, and extend out of the connectors to be connected with operating parts.

Wherein, when the positions of the connection shafts in the arc grooves are fixed, the arc grooves extend to form idling grooves in the axial direction of the plug pins; and oblique planes are arranged at the ends of the plug pins and incline in a manner that the small tubes abut against the oblique planes when moving upwards to make the plug pins tend to be away from the small tubes.

Wherein, when the small tubes are released from being positioned, the rotary parts are locked with the connectors in an interference fit manner.

According to the utility model, the ladder further comprises triggers rotationally connected with the connectors, and plug pin installation parts are formed with plug pin installation cavities allowing the plug pins to move therein and are linked with the triggers.

Wherein, a linkage structure of the triggers and the plug pin installation parts is as follows: the triggers are provided with cam blocks; after the triggers rotate by a preset angle, the plug pin installation parts abut against the cam blocks and are resisted in the direction away from the small tubes; and after the triggers rotate by another preset angle, the plug pin installation parts are released from being resisted by the cam blocks.

Wherein, a linkage structure of the triggers and the plug pin installation parts is as follows: the triggers are provided with the cam blocks; after the triggers rotate by the preset angle, the plug pin installation parts abut against the cam blocks and are resisted in the direction away from the small tubes; and after the triggers rotate by another preset angle, the plug pin installation parts are released from being resisted by the cam blocks.

Compared with the prior art, the utility model has the following advantages and effects: the tool platform has a stretchable lifting positioning structure, so that the logistical and packaging size can be reduced. When the lifting positioning structure is used, the tool platform moves upwards accordingly when the small tubes move upwards, and a user can climb the ladder more stably by means of the upward movement of the small tubes or the tool platform.

DETAILED DESCRIPTION OF THE EMBODIMENTS

The utility model is further expounded below in combination with the accompanying drawings and embodiments, and the following embodiments are used for explaining the utility model, and are not intended to limit the utility model.

Embodiment 1

Figure 1:
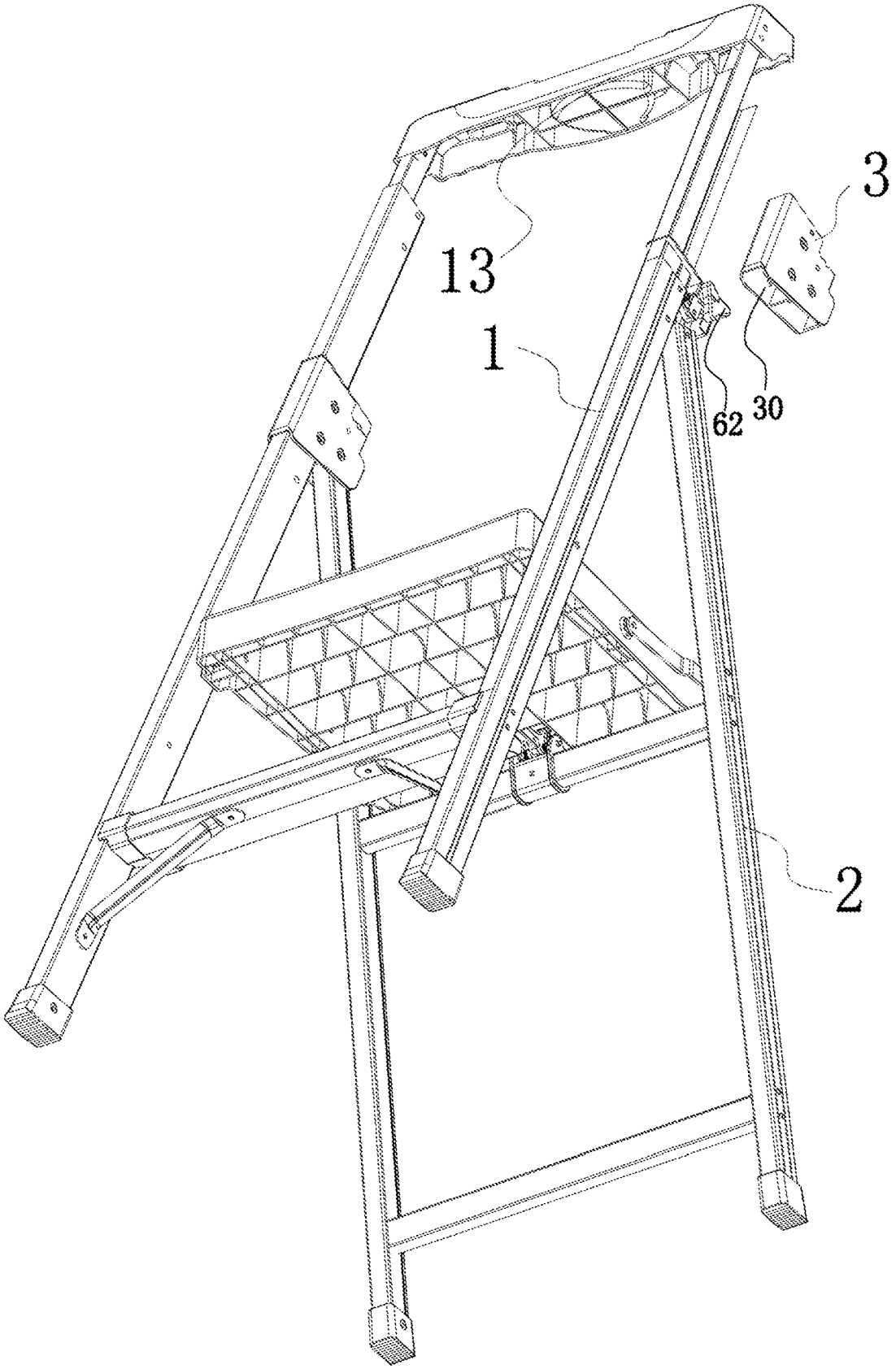
FIG. 1 is a structural view of the utility model.
Figure 2:
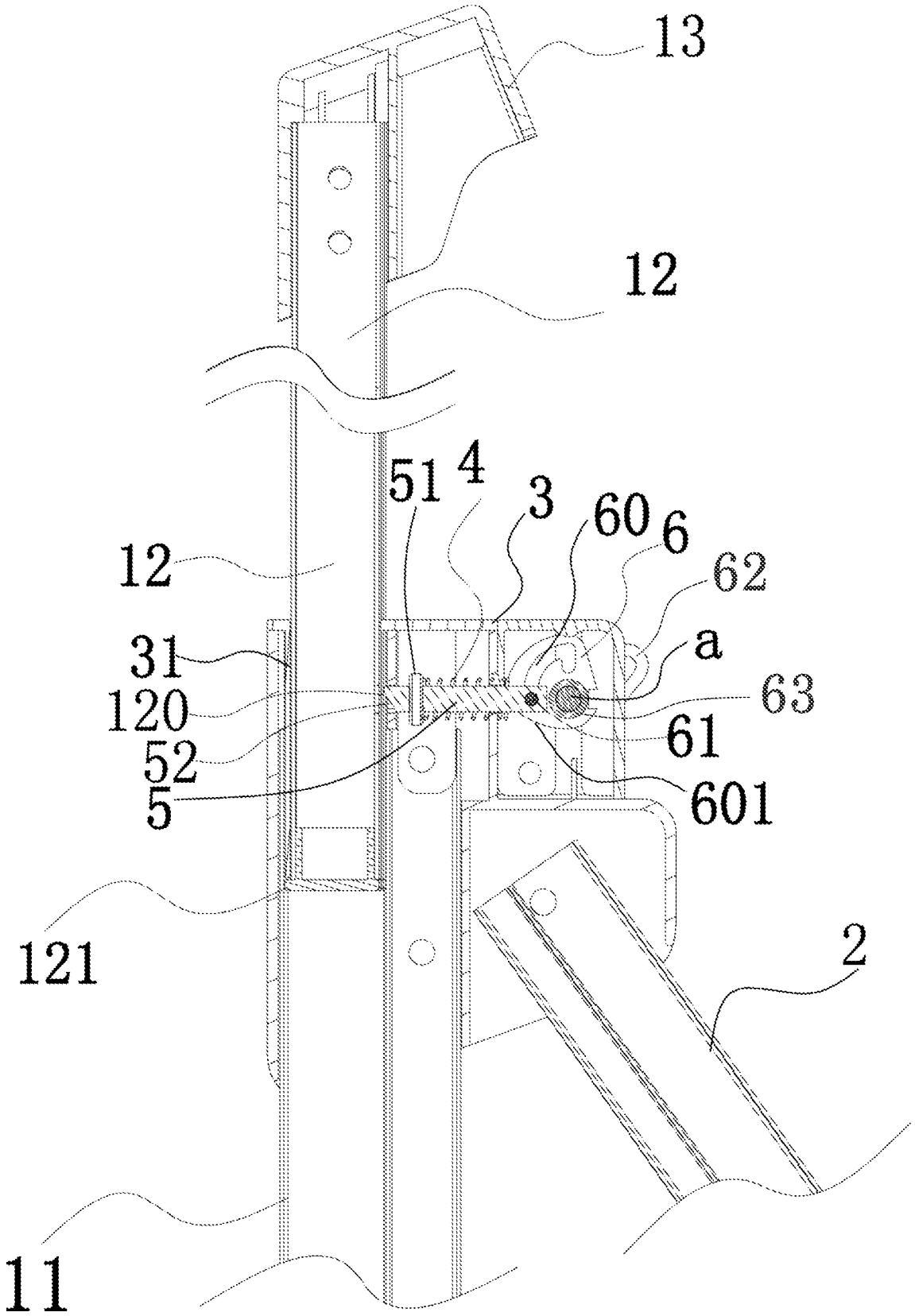
FIG. 2 is a structural view of the utility model released from a positioning state.
Figure 3:
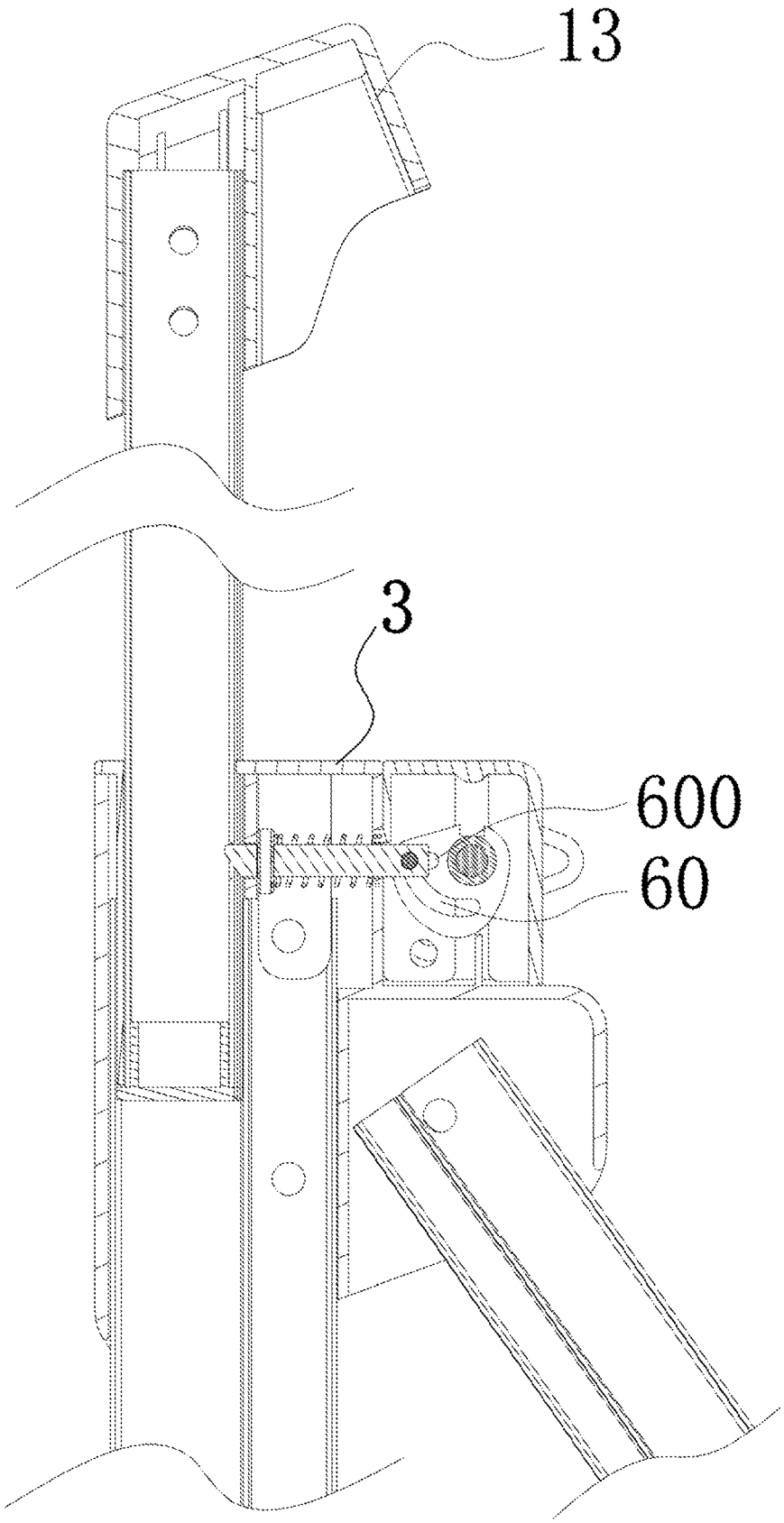
FIG. 3 is a structural view of the utility model in a positioning state.

Referring to FIG. 1 to FIG. 3, a lifting positioning structure for a ladder tool platform is characterized in that a ladder comprises front supporting legs 1, rear supporting legs 2, connectors 3 fixedly connected with the front supporting legs 1, plug pins 5, and elastic parts 4, wherein each front supporting leg 1 includes a big tube 11 and a small tube 12 which are able to relatively move in an extension direction; the connectors 3 are formed with vertically-through installation cavities 30 which allow the big tubes 11 to be inserted therein; the big tubes 11 are arranged in the installation cavities 30 and are fixedly connected with the connectors 3 which extend to form connection parts rotationally connected with the rear supporting legs 2, and the small tubes 12 are connected with a tool platform 13; the plug pins 5 are movably arranged on the connectors 3 or the big tubes 11; the elastic parts 4 apply an acting force to the plug pins 5 to make the plug pins 5 tend to position the small tubes 12, and the small tubes 12 are positioned after abutting against the plug pins 5; and the plug pins 5 overcome the resistance of the elastic parts 4 under an external force to move away from the small tubes 12, so that the small tubes 12 are released from being positioned. The installation cavities 30 of the connectors 3 in this embodiment are open or closed; the open connectors 3 have openings formed in side faces, such as connectors 3 formed by two iron sheets; the closed connectors 3 have encircled side walls, such as plastic connectors formed by injection molding; and the vertically-through installation cavities 30 have closed circumferences. In a specific implementation of this embodiment, the number of the front supporting legs 1 and the number of the rear supporting legs 2 are two, and the tool platform 13 is connected between the two small tubes 12 and is generally located above the small tubes 12. The plug pins 5 move away from the small tubes 12 under an external force applied by a user, so that the small tubes 12 are released from being positioned. When no external force is applied, the elastic parts 4 apply a force to the plug pins 5 to make the plug pins 5 get close to the small tubes 12 to abut against the small tubes 12, so that the small tubes 12 are correspondingly positioned.

The plug pins 5 in this embodiment are provided with shield parts 51 to abut against springs, the elastic parts 4 are the springs disposed around the plug pins 5 capable of moving along their axial directions, and the springs have one ends abutting against the shield parts 51 and the other ends abutting against the connectors 3 or derivative parts connected with the connectors 3. The derivative parts include any supporting parts such as the big tubes 11, the rear supporting legs 2, and rotary parts 6.

In this embodiment, the small tubes 12 arranged in the installation cavities 30 are provided with flanges 121 protruding relative to the external diameters of the small tubes 12; the flanges 121 are directly formed on the small tubes 12, or end plugs are fixedly arranged below the small tubes 12, and the external edges of the end plugs extend out of the external diameters of the small tubes 12 to form the flanges 121; covers 31 are arranged over the installation cavities 30; and when the small tubes 12 move upwards, the flanges 121 abut against the covers 31, and the plug pins 5 are located at the lower ends of the small tubes 12, so that the small tubes are positioned. In this structure, the covers 31 are fixedly arranged over the installation cavities 30; and when the small tubes 12 move upwards, the flanges 121 abut against the covers 31, the plug pins 5 abut against the lower ends of the small tubes 12, and the big tubes 11 are locked with the small tubes 12. In this structure, the small tubes 12 are supported by the plug pins 5 and are shielded by the covers 31 to be limited, so that vertical bi-directional positioning is fulfilled.

Preferably, in this embodiment, the small tubes 12 are formed with holes 120 allowing the plug pins 5 to be inserted therein, and when the plug pins 5 are inserted into the holes 120, the small tubes 12 are positioned.

Preferably, in this embodiment, the ladder further comprises rotary parts 6 which are rotationally connected with the connectors 3 and formed with arc grooves 60, the plug pins 5 are connected with connection shafts 61 arranged in the arc grooves 60, and a distance between the arc grooves 60 and rotational connection points a of the rotary parts 6 and the connectors 3 is variable, is preferably varied smoothly and can be increased or decreased by rotation as needed. In this embodiment, the connection shafts 61 move along the arc grooves 60 by means of rotation of the rotary parts 6, and when the positions of the connection shafts 61 in the arc grooves 60 tend to get close to the rotational connection points a, the distance between the arc grooves 60 and the rotational connection points a of the rotary parts 6 and the connectors 3 is decreased, and the small tubes 12 tend to be released from being positioned. Otherwise, the distance between the arc grooves 60 and the rotational connection points a of the rotary parts 6 and the connectors 3 is increased, and the small tubes 12 tend to be positioned. The rotary parts 6 are plastic parts or metal parts, the arc grooves 60 are grooves, and the bottoms of the arc grooves 60 in this application are opened or not opened. Preferably, when the small tubes 12 are released from being positioned, the rotary parts 6 are locked with the connectors 3 in an interference fit manner, and the small tubes 12 can move freely; and when the tool platform 13 is stored, the ladder can be folded in one step.

Preferably, arc edges 601 are arranged at the peripheries of the arc grooves 60 in this embodiment and abut against the ends, abutting against the connectors or the derivative parts, of the springs. This structure is compact and effectively adopts the arc edges 601 to abut against the ends of the springs.

Preferably, the number of the arc grooves 60 is two, and the connection shafts 61 are respectively arranged in the two arc grooves 60 which are symmetrically formed in two sides of the plug pins 5 to keep the two sides balanced and stable operation.

Preferably, rotation shafts 63 are arranged at the rotational connection points a of the rotary parts 6 and the connectors 3, are fixedly connected with the rotary parts 6 and extend out of the connectors 3 to be connected with operating parts 62. The rotation shafts 63 controls the rotary parts 6 to rotate when the external operating parts 62 rotate, so that operation is convenient.

Preferably, when the positions of the connection shafts 61 in the arc grooves 60 are fixed, the arc grooves 60 extend to form idling grooves 600 in the axial direction of the plug pins 5; and oblique planes 52 are arranged at the ends, facing the small tubes 12, of the plug pins 5 and incline in such a manner that the small tubes 12 abut against the oblique planes 52 when moving upwards to make the plug pins 5 tend to be away from the small tubes 12. In this structure, the plug pins 5 are pushed by the elastic parts 4 to abut against the small tubes 12 to lock the small tubes 12, the arc grooves 60 extend in the reverse direction of the locking direction to form the idling grooves 600, and an external force is applied to make the plug pins 5 away from the small tubes 12 to form movable spaces; and the oblique planes 52 are arranged at the ends of the plug pins 5 and incline in such a manner that oblique planes 52 extend upwards from the external sides of the plug pins 5 to a small tubes 12 side, and when the small tubes 12 are pulled by a user to move upwards, the small tubes 12 abut against the oblique planes 52 to make the plug pins 5 tend to be away from the small tubes 12, so that the small tubes 12 are released from being positioned. The small tubes 12 are positioned again when downwards pulled to the next hole 120. This oblique structure has no slop to make the plug pins 5 retract when the small tubes 12 move downwards, the small tubes 12 are supported by the plug pins 5 when moving downwards and thus are unable to move downwards, and the tool platform 13 can bear tools. The height of this structure can be conveniently and gradually adjusted by a user as needed.

Embodiment 2

Figure 4:
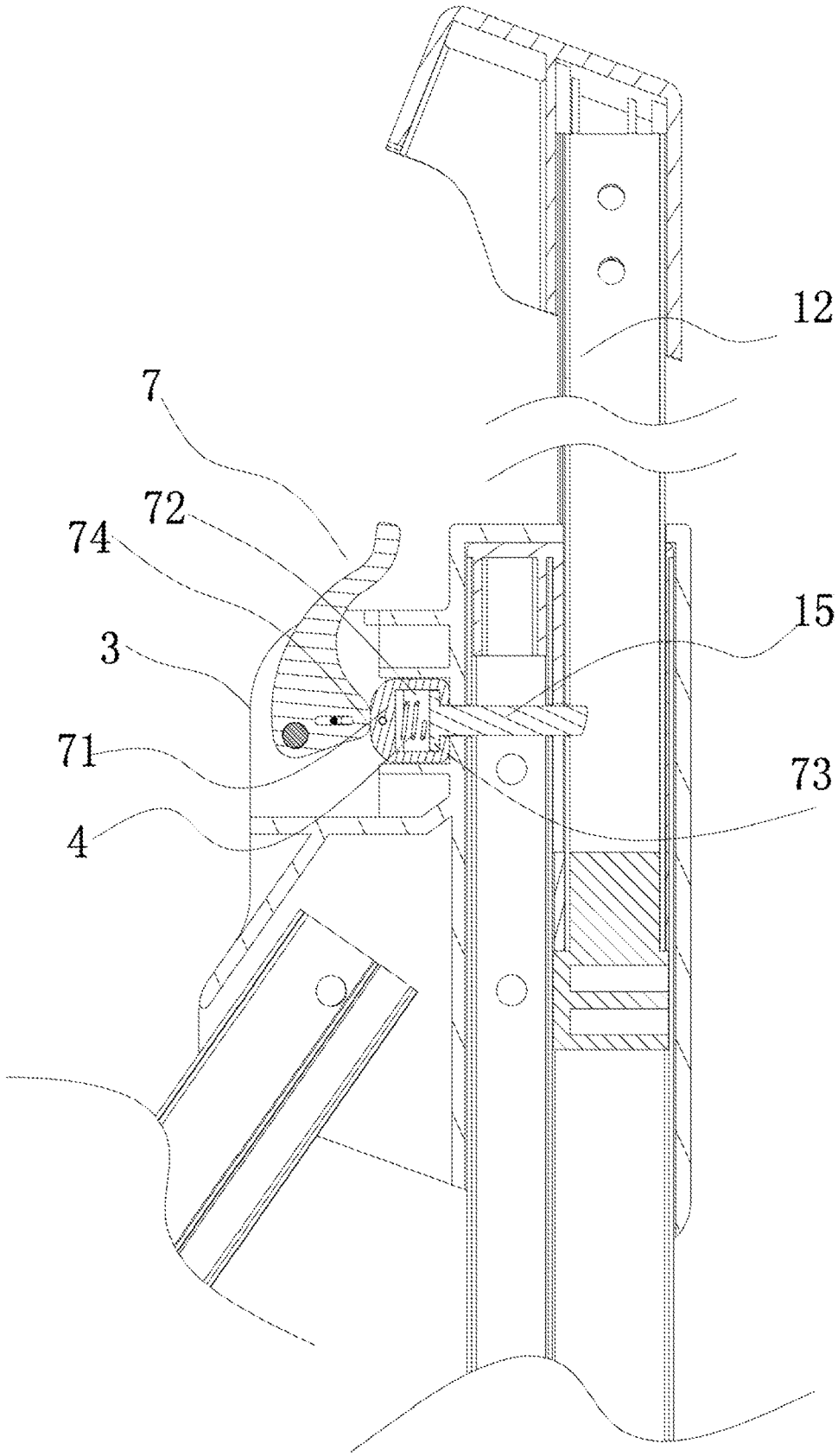
FIG. 4 is a structural view of Embodiment 2 of the utility model.

Embodiment 2 is a substitutive implementation of Embodiment 1 in the aspect of control of the rotary parts 6 over plug pins 15. As shown in FIG. 4, in this embodiment, the ladder further comprises triggers 7 rotationally connected with the connectors 3, and plug pin installation parts 71 are formed with plug pin installation cavities 72 allowing the plug pins 15 to move therein and are linked with the triggers 7. The plug pin installation cavities 72 are formed with openings, swelled ends of the plug pin installation parts 71 are arranged in the installation cavities via the openings, and the specific implementation is as follows: the ends are connected with shield plates 73 larger than the openings in size, the plug pins 15 are shielded by the shield plates 73 when linearly moving in their axial directions to disengage from the installation cavities, thus being limited in the axial directions in the plug pin installation cavities 72.

In this embodiment, a linkage structure of the triggers 7 and the plug pin installation parts 71 is as follows: the triggers 7 are provided with cam blocks 74; after the triggers 7 rotate by a preset angle, the plug pin installation parts 71 abut against the cam blocks 74 and are resisted in the direction away from the small tubes; and after the triggers 7 rotate by another preset angle, the plug pin installation parts 71 are released from being resisted by the cam blocks 74 to be set free, and the original state of the plug pin installation parts 71 can be changed under the external force. In this embodiment, when the cam blocks 74 abut against the plug pin installation parts 71, the plug pin installation parts 71 cannot retreat, and the plug pins 15 are pushed by the elastic parts 4 to abut against the small tubes, so that the small tubes are positioned; and the plug pin installation parts 71 can retreat under an elastic force of the elastic parts 4 in a free state, so that the small tubes are released from being positioned. The elastic parts 4 are springs.

In this embodiment, a linkage structure of the triggers 7 and the plug pin installation parts 71 is as follows: the triggers 7 are provided with the cam blocks 74; after the triggers 7 rotate by a preset angle, the plug pin installation parts 71 abut against the cam blocks 74 and are resisted in the direction away from the small tubes; and after the triggers 7 rotate by another preset angle, the plug pin installation parts 71 are released from being resisted by the cam blocks 74 and are pulled by the triggers 7 through connection rods to move away from the small tubes. In this embodiment, the triggers 7 rotate to drive the plug pin installation parts 71 to move away, so that the small tubes are released more stably and reliably.

The above embodiments described in the specification are only illustrative ones of the utility model. Various modifications, supplements, or similar substitutions of these specific embodiments can be made by those skilled in the art without deviating from the contents in the specification of the utility model and the scope defined by the appended claims of the utility model, and all these modifications, supplements, or similar substitutions should also fall within the protection scope of the utility model.

What is claimed is:

1. A lifting positioning structure for a ladder tool platform, comprising a ladder, wherein the ladder comprises front supporting legs, rear supporting legs, connectors fixedly connected to the front supporting legs, plug pins, and elastic parts;

each front supporting leg includes a big tube and a small tube, and the big tube and the small tube are configured to relatively move in an extension direction;

the connectors are formed with vertically-through installation cavities; the big tubes are inserted in the vertically-through installation cavities; the big tubes are arranged in the vertically-through installation cavities and are fixedly connected to the connectors; the connectors extend to form connection parts rotationally connected to the rear supporting and the small tubes are connected to a tool platform;

the plug pins are movably arranged on the connectors or the big tubes; and the elastic parts apply an acting force to the plug pins to make the plug pins tend to position the small tubes, and the small tubes are positioned after abutting against the plug pins; and the plug pins overcome a resistance of the elastic parts under an external force to move away from the small tubes, and the small tubes are released from being positioned, wherein the ladder further comprises rotary parts, the rotary parts are rotationally connected to the connectors and formed with arc grooves; the plug pins are connected to connection shafts arranged in the arc grooves, and a distance between the arc grooves and rotational connection points of the rotary parts and the connectors is variable; and the connection shafts move along the arc grooves by rotating the rotary parts; when the connection shafts in the arc grooves get close to the rotational connection points, the small tubes are released from being positioned; and when the connection shafts in the arc grooves are not close to the rotational connection points, the small tubes are in position.

2. The lifting positioning structure for the ladder tool platform according to claim 1, wherein the plug pins are provided with shield parts to abut against springs; the elastic parts are the springs disposed around the plug pins; the plug pins are configured to move along their axial directions; the springs have ends abutting against the shield parts and ends abutting against the connectors or derivative parts connected to the connectors.

3. The lifting positioning structure for the ladder tool platform according to claim 1, wherein the small tubes arranged in the vertically-through installation cavities are provided with flanges protruding relative to external diameters of the small tubes; covers are arranged over the installation cavities; and when the small tubes move upwards, the flanges abut against the covers, the plug pins are located at lower ends of the small tubes, and the small tubes are in position.

4. The lifting positioning structure for the ladder tool platform according to claim 1, wherein the small tubes are formed with holes; the plug pins are inserted in the holes; and when the plug pins are inserted into the holes, the small tubes are ire position.

5. The lifting positioning structure for the ladder tool platform according to claim 1, wherein arc edges are arranged at peripheries of the arc grooves and abut against the ends, abutting against the connectors or the derivative parts, of the springs.

6. The lifting positioning structure for the ladder tool platform according to claim 1, wherein the number of the arc grooves is two, and the connection shafts are respectively arranged in the two arc grooves.

7. The lifting positioning structure for the ladder tool platform according to claim 1, wherein rotation shafts are arranged at the rotational connection points of the rotary parts and the connectors, are connected to the rotary parts, and extend out of the connectors to be connected to operating parts.

8. The lifting positioning structure for the ladder tool platform according to claim 1, wherein when positions of the connection shafts in the arc grooves are fixed, the arc grooves extend to form idling grooves in an axial direction of the plug pins; and oblique planes are arranged at ends of the plug pins; and the small tubes abut against the oblique planes when moving upwards to make the plug pins tend to be away from the small tubes.

9. The lifting positioning structure for the ladder tool platform according to claim 1, wherein when the small tubes are released from being positioned, the rotary parts are locked with the connectors in an interference fit manner.

10. The lifting positioning structure for the ladder tool platform according to claim 2, wherein the small tubes arranged in the vertically-through installation cavities are provided with flanges protruding relative to external diameters of the small tubes; covers are arranged over the installation cavities; and when the small tubes move upwards, the flanges abut against the covers, the plug pins are located at lower ends of the small tubes, and the small tubes are in position.

11. The lifting positioning structure for the ladder tool platform according to claim 2, wherein the small tubes are formed with holes; the plug pins are inserted in the holes; and when the plug pins are inserted into the holes, the small tubes are in position.

* * * * *